US005916082A

United States Patent [19]

Opfer

[11] Patent Number: 5,916,082

[45] Date of Patent: Jun. 29, 1999

[54] CENTRIFUGAL SEPARATOR WITH INVERTABLE BLADDER

[75] Inventor: Mark H. Opfer, Pemberville, Ohio

[73] Assignee: Glassline Corporation, Perrysburg, Ohio

[21] Appl. No.: 09/132,835

[22] Filed: Aug. 12, 1998

[51] Int. Cl.[6] ..... B04B 11/04

[52] U.S. Cl. ..... 494/26; 494/45; 494/47; 494/65

[58] Field of Search ..... 494/11, 36, 43–45, 494/47, 48, 55, 56, 64, 65, 85, 901, 26; 210/370

[56] References Cited

U.S. PATENT DOCUMENTS

| | | | |
|---|---|---|---|
| 2,179,807 | 11/1939 | Asmussen | 494/45 |
| 2,585,753 | 2/1952 | Drury | 494/45 |
| 3,104,225 | 9/1963 | Di Benedetto | 494/45 |
| 4,397,637 | 8/1983 | Place | 494/45 |
| 4,983,156 | 1/1991 | Knelson | 494/45 |
| 5,370,600 | 12/1994 | Fitch, Jr. et al. | 494/45 |
| 5,433,230 | 7/1995 | Miller . | |
| 5,454,777 | 10/1995 | Ziems et al. | 494/10 |
| 5,512,031 | 4/1996 | Ziems et al. . | |
| 5,661,230 | 8/1997 | Morrison . | |
| 5,713,826 | 2/1998 | West | 494/56 |
| 5,823,937 | 10/1998 | Carr | 494/65 |

FOREIGN PATENT DOCUMENTS

| | | | |
|---|---|---|---|
| 310418 | 2/1930 | United Kingdom | 494/45 |

*Primary Examiner*—Charles E. Cooley
*Attorney, Agent, or Firm*—Emch, Schaffer, Schaub & Porcello Co.

[57] ABSTRACT

This separator is a centrifugal device for separating solids from contaminated effluent such as oil or water base coolants and other liquids which are used in a variety of grinding and machining applications in the glass, ceramic and metal-forming industries. A containment liner or bladder lines the interior of the separator and communicates with fluid inlets and outlets. An inlet orifice allows for the pulling of a vacuum which holds the bladder in place on the interior walls of the separator. Periodically, rotation is stopped, vacuum is released and the bladder is allowed to invert and drop below the separator. Hanging in this inverted position, it is easy to clean or remove the solids from the inverted bladder.

20 Claims, 3 Drawing Sheets

CENTRIFUGAL SEPARATOR WITH INVERTABLE BLADDER

TECHNICAL FIELD

This invention relates to a centrifugal separation device for separating solids from contaminated effluent such as oil base coolants and other liquids which are used in a variety of grinding and machining applications in the glass, ceramic and metal-forming industries.

BACKGROUND ART

In a centrifugal separator, the separation of solids from the liquid is commonly accomplished by pumping the contaminated coolant or liquid into a high speed rotating chamber or bowl. The centrifugal gravitational forces created by the high speed rotation of the chamber cause the contaminated fluid to conform to the interior outside vertical surface of the rotating chamber. Since the chamber is rotating at a high speed, the solid material is forced to adhere to the side of the bowl or chamber while the cleansed coolant or liquid exists through openings commonly located at the bottom of the bowl to be drained away through an outlet pipe. Automatic cleansing systems have been provided, wherein scraper blades mounted inside the rotating bowl are activated to automatically scrape or plow the solids from the side of the bowl and expel them into a sludge container mounted below the unit.

One improved apparatus provides for enhancing the operation of a centrifugal separator and automatically adjusting for varying amounts of solids in contaminated fluid being passed through the separator. This includes a load sensing circuit which monitors the load on the drive motor of the separator centrifuge bowl and signals for a cleaning cycle based upon the load information. Another centrifuge uses an inverted filter. Dewatering is accomplished by pressurization and displacement of liquids through a packed filter bed. Wet solids then are removed from the filter bed.

Despite these improvements, the scraper blades are hard to clean as wet solids stick to the blades. Filter cloth and packed filter beds have their own inherent set of clogging problems. Moving fluid through a packed filter bed and filter cloth demands high pressure and often is not efficient.

DISCLOSURE OF INVENTION

The apparatus of this invention eliminates the scraper blades, filter cloths and their attendant problems. A containment liner or bladder lines the interior of the separator and communicates with fluid inlets and outlets. An inlet orifice allows for the pulling of a vacuum which holds the bladder in place on the interior walls of the separator. As with a separator with scraper blades, the centrifugal gravitational forces created by the high speed rotation of the chamber cause the contaminated fluid to conform to the interior outside vertical surface of the rotating chamber. Except in the apparatus of this invention, the interior outside surface is lined with the bladder I employ. Since the chamber is rotating at a high speed, the solid material is forced to adhere to the bladder while the cleansed coolant or liquid exits through openings commonly located at the bottom of the bowl to be drained away through an outlet pipe.

The bladder centrifuge is specifically designed for the clarification of liquids containing solid particles. The unit utilizes centrifugal force to perform the liquids/solids separation and automatically discharges the dewatered (relatively low moisture content) solids at the end of the processing cycle. The feed slurry is normally less than 10% solids by volume, enters the centrifuge at the dirty liquid inlet at the bottom of the machine. The slurry is forced upward through an angled, injector feed pipe or pipes where the slurry is accelerated and then distributed to the inside diameter of the bladder lined bowl. The injectors are outside the bowl and spray the slurry to the top corners of the bladder lined bowl. The slurry hits the top corners of the bladder in an arcuate path since the bowl is already spinning. As the slurry enters the top of the bowl, it undergoes a centrifugal force variable to 500 to 1800 gravities. The solids settle against the bladder and the clarified liquid moves toward the open bottom of the bowl where it is discharged to the clean liquid outlet. Radial settling vanes may be incorporated in the bowl wall to enhance the liquid/solid separation by preventing vortexing of the liquid and providing a quiescent liquid zone for the settling solids.

Periodically, rotation is stopped, vacuum is released and the bladder is allowed to invert and drop below the separator. Compressed air is used to invert the bladder. Hanging in this inverted position, it is easy to clean or remove the solids from the inverted bladder. The advantages of the bladder are that one does not have scraper blades to maintain or any of the mechanism that drives the scraper blades. Nor does one have plugged filter cloths or filter beds as no solids or liquids pass through the bladder. When the vacuum is stopped, compressed air helps invert the bladder for cleaning. The angled injectors are displaced such that they are not in the path of the dropped bladder or cleaned fluid inlet.

BRIEF DESCRIPTION OF THE INVENTION

BEST MODE OF CARRYING OUT INVENTION

Figure 1:
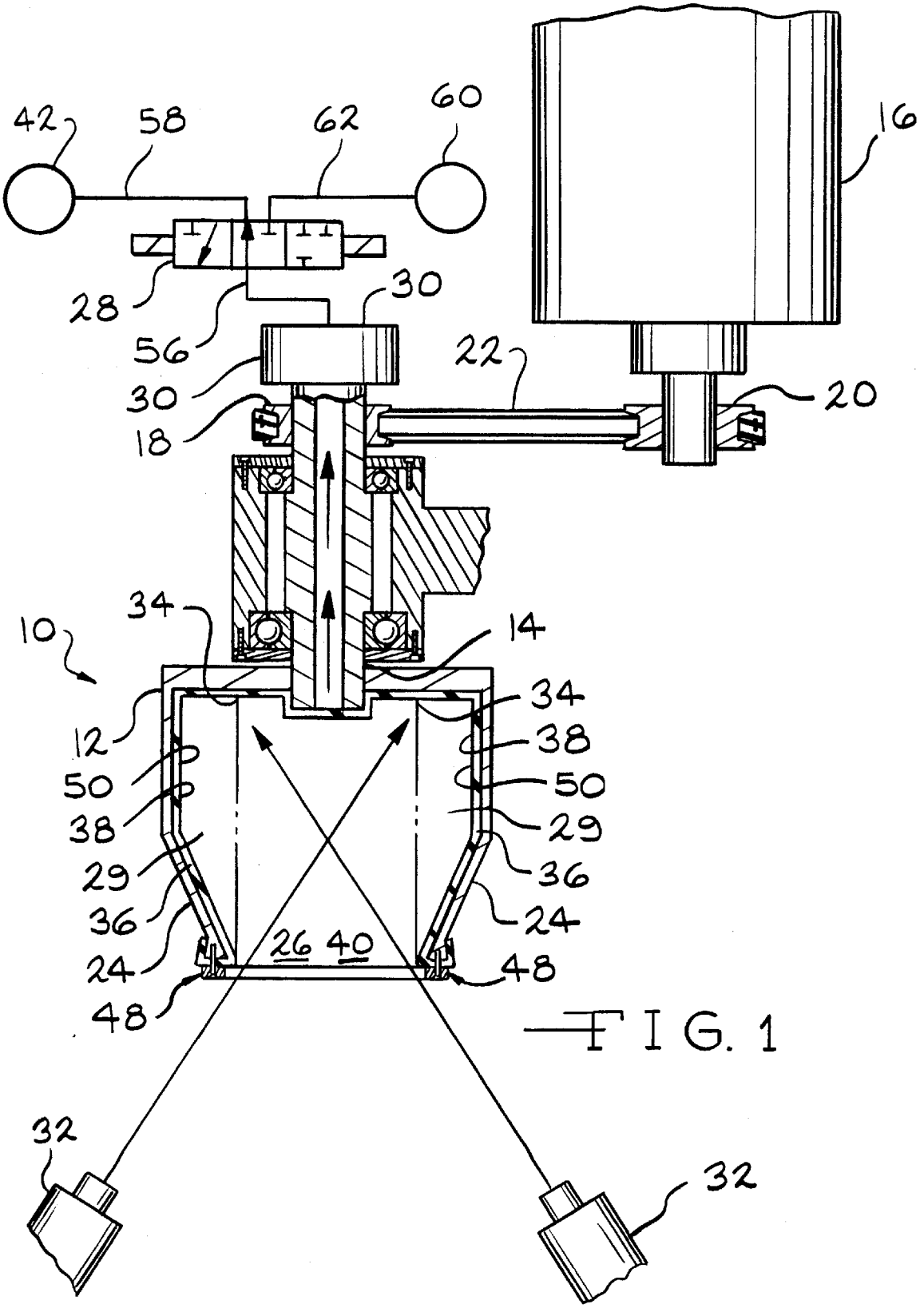
FIG. 1 is a schematic diagram of a centrifugal separator incorporating the bladder of this invention.
Figure 2:
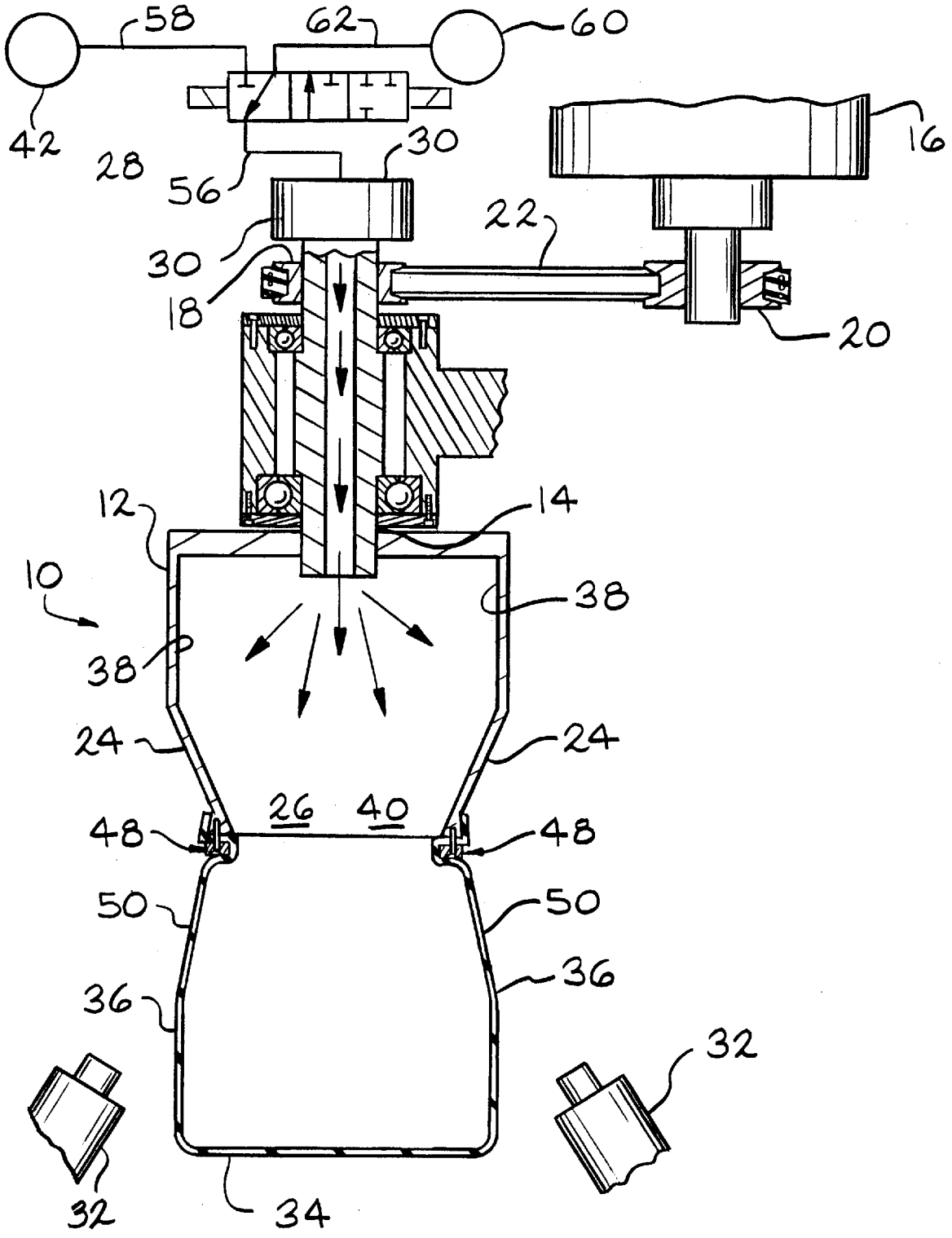
FIG. 2 is a schematic diagram of a centrifugal separator with the bladder in an inverted position.

FIGS. 1 and 2 shows centrifugal separator 10 having a housing (not shown) which encloses centrifugal bowl 12 mounted on centerline shaft 14. Shaft 14 is engaged with drive motor 16, preferably through pulleys 18, 20 located on the shaft 14 and drive motor 16 respectively. A belt 22 interconnects the shaft pulley 18 with the motor pulley 20. Preferably, the centrifugal bowl 12 defines a shape that is cylindrical for approximately two-thirds of length. The conical lower portion 24 narrows to create opening 26 at the bottom of bowl 12 that is generally one-half the diameter of the cylindrical portion of bowl 12. Cleansed fluid will be expelled through opening 26 into the fluid outlet line (not shown) during the centrifuge operation. Dehydrated solids 29 collect on the bladder during centrifuge. Shaft 14 is fixed within a bearing cartridge (not shown) affixed to housing 10. Shaft 14 is hollow along its full length about its centerline and includes a boxed bearing housing or rotary joint 30 positioned above the shaft pulley 18.

Separator 10 includes effluent inlet 32 which provides contaminated fluid to the interior of bowl 12. Preferably, inlet 32 is at least one pair of angled injectors which spray slurry through opening 26 to top corners 34 of bladder 36. While one inlet (injector) 32 may be used, I prefer to use pairs of injectors and typically employ 2, 4, 6 or 8 injectors. The key is for the slurry to hit near the corner 34. The resulting spray travels in an arcuate path since bowl 12 and bladder 36 formed by the water column and bowl lid are spinning. As a result, this prevents the slurry from forming a washing action on the cake already built up on bladder 36. Preferably, injectors 32 are flush with the plane that defines the circumference or perimeter of opening 26. As a result, when bladder 36 drops below opening 26, it will not contact the tips or any sharp edges on injectors 32.

Bladder 36 lines interior surface 38 of bowl 12. Bladder 36 is bag-like with open bottom end 40. Vacuum means 42 also extends through hollow shaft 14 and terminates in cavity 44 between bladder 36 and top interior surface 46 of bowl 12. Cavity 44 is shown in FIG. 2, but not in FIG. 1.

Vacuum source 42 and compressed air source 60 connect to valve 28. Valve 28 regulates the vacuum or air pressure, as well as switching back and forth between source 42 and source 60.

Vacuum source 42 may pull a vacuum ranging from 0 to 30 inches Hg. Typically, vacuum source 42 pulls a vacuum ranging from 20 to 24 inches Hg. The vacuum needed is only great enough to hold bladder 36 in place in bowl 12. Compressed air 60 may have a pressure ranging up to 65 psi. Again, compressed air 60 need only be great enough to lower bladder 36. Both vacuum and compressed air pressure should be held to the minimum needed.

FIGS. 1 and 2 also show flange 48 circumscribes open bottom end 40 and holds bladder 36 in place around opening 26 at the bottom of bowl 12. When centrifuge bowl 12 is in operation, solids 29 collect on interior surface 50 of bladder 36. When bowl 12 is not in operation, bladder 36 is free to drop or is pushed through opening 26. Since flange 48 holds end 40 in place, bladder 36 inverts and surface 50 is exposed. The solid material then drops into a solid material collection bin (not shown).

In another embodiment, vacuum means 42 may not be necessary once start-up is accomplished. The force of the spray from injectors 32 may be sufficient to hold bladder 36 against interior surface 38 of bowl 12. The force of the spray and rotation will push bladder 36 to the top corners of bowl 12.

Preferably, drive motor 16 of the centrifuge rotor is a variable speed motor capable of operating the centrifuge in a range of 2,000 rpm to 3,000 rpm. The variability of speed is necessitated for variations in treatable particle size, particle specific gravity, degree of dehydration of collected solids and the solid/liquid ratio. The variable speed for drive motor 16 assists in sensing the torque/current load of rotor bowl 12 which is used to initiate cycles. Variable speed motor 16 will accelerate centrifuge bowel 12 to its running speed over a timed interval, thus allowing for a smaller horsepower drive motor to be utilized. To insure that all liquid is drained from bowl 12, variable speed drive motor 16 will ramp down or decelerate the centrifuge bowl over a timed interval in order to properly drain liquid remaining in the bowl 12 to the clean tank as it exits opening 26 of the bowl through outlet line 28.

The processing cycle continues until the settled solids build up on the bladder to a point required cleaning. The length of the processing cycle is controlled by a timer. Once this timer times out, the feed pump shuts off and the cleaning preparation phase of the cycle is automatically initiated. The drive motor stops and the bowl decelerates to a complete stop. The liquid remaining in the bowl drains into the drain plate and is returned to the dirty liquid feed tank.

Next, the cleaning cycle is automatically initiated. The pneumatic activated evacuation system is engaged, vacuum is stopped and the bladder drops and loosens the solids. Compressed air is used to invert the bladder. Simultaneously, the drain plate slide activator is engaged, retracting the drain plate and opening the bottom of the rotor to the dewatered solids cart, drum or receptacle. The solids then drop out of the bottom of the machine into your receptacle for reclamation or disposal. At the completion of the cleaning cycle, the drain plate is returned to its original position and the operating cycle is repeated automatically.

An operator can run this separator manually or with the aid of a programmable controller (PLC) such as U.S. Pat. No. 5,454,777 describes. FIG. 1 of U.S. Pat. No. 5,454,777 discloses cabinet or housing 10 and fluid outlet line 40 which removes the cleansed fluid flowing from the separator. These features and U.S. Pat. No. 5,454,777 are herein incorporated by reference.

Figure 3:
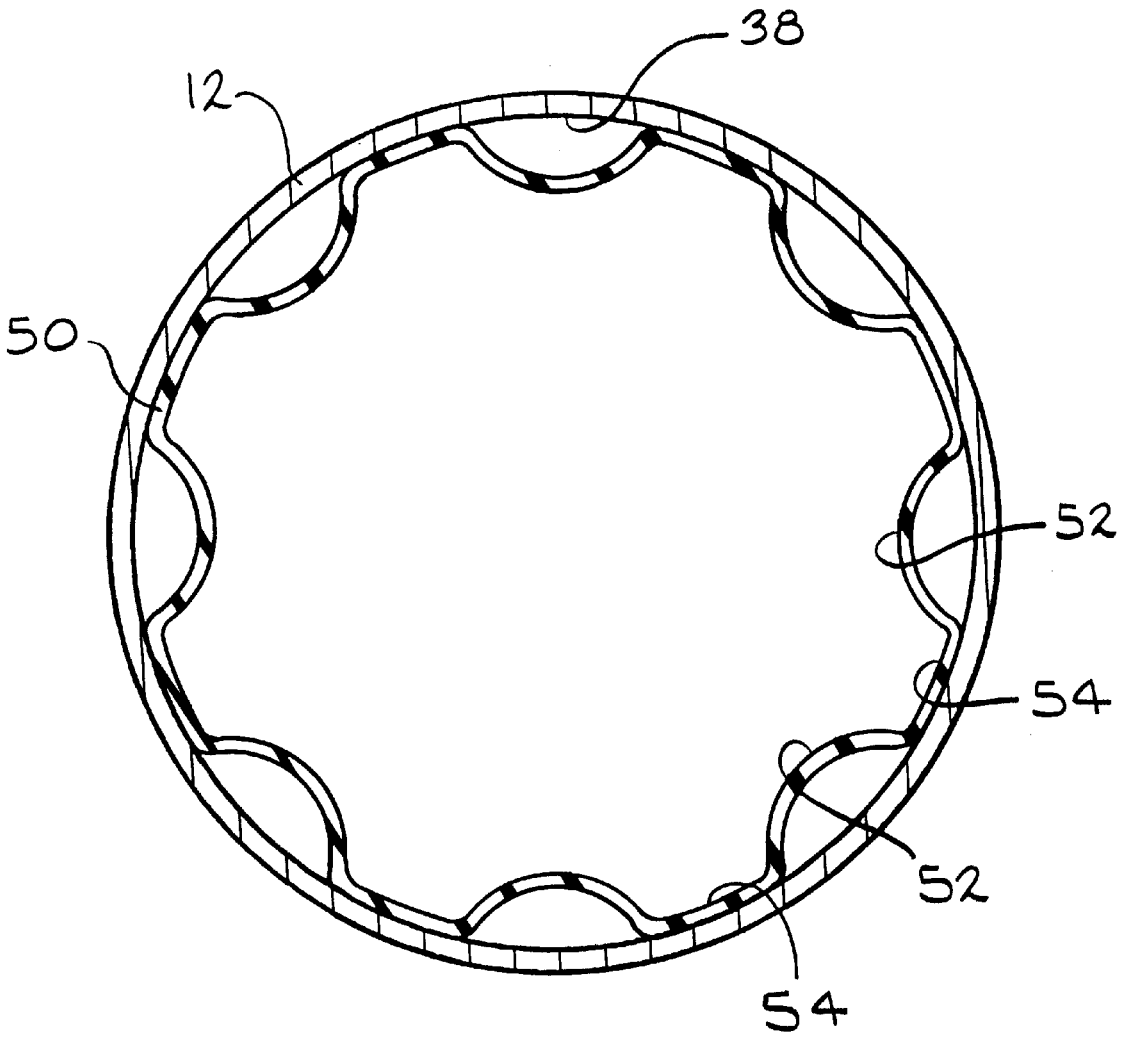
FIG. 3 shows the bladder having an irregular interior surface.

FIG. 3 shows a preferred embodiment where bladder 36 has interior surface 50 which is an irregular surface. Irregular surface 50 typically has ridges or peaks 52 and valleys or troughs 54. Irregular surface 50 is especially useful during start-up as ridges 52 and troughs 54 will hold the slurry better than a smooth surface. Irregular surface 50 may be referred to as corrugated or convoluted.

FIGS. 1 and 2 also show that vacuum source 42 and compressed air source 60 feed through passage 56 extending through the hollow portion of shaft 14. Air feed passage 56 connects to air discharge valve 28. Vacuum source 42 connects to valve 28 through air hose 58. Compressed air source 60 connects to valve 28 through air hose 62.

Bladder 36 can be made from a wide variety of elastomeric materials. Preferably, I use a bladder of silicone rubber or latex rubber. Elastomers as used herein refer to synthetic thermosetting polymers having properties similar to those of vulcanized natural rubber, namely, the ability to be stretched to at least twice their original length and to retract very rapidly to approximately their original length when released. Other examples includes styrene-butadiene copolymer, polychloroprene(neoprene), nitrile rubber, butyl rubber, polysulfide rubber, cis-1,4-polyisoprene, ethylene-propylene terpolymers (EPDM rubber), silicone rubber, and polyurethane rubber. These can be cross-linked with sulfur, peroxides, or similar agents. Uncross-linked polyolefins that are thermoplastic also are included as is natural rubber.

The above description of the preferred embodiment of the invention is intended to be illustrative in nature and not necessarily limiting upon the scope of the following claims.

I claim:

1. A centrifugal separator having a centrifuge bowl, the bowl having an interior, an interior surface, an upper end, a lower end, an axial centerline wherein the lower end has an opening communicating with the interior and wherein the upper end is connected to a shaft in alignment with the axial centerline of the bowl, a drive member for inducing rotation of the bowl to produce high gravitational centrifugal forces within the bowl, a bladder lining the interior surface of the bowl, the bladder having an interior, an interior surface and a lower opening communicating with the interior of the bladder wherein the opening of the bowl circumscribes the opening of the bladder, and at least one inlet located below and outside the bowl for providing fluid entrained with solid particulate to the interior of the bladder, wherein the opening of the bladder also is an outlet for removing cleansed fluid from the interior of the bladder.

2. A separator according to claim 1 wherein the bladder is made of an elastomeric material capable of inverting and falling through or being pulled through the opening of the bowl.

3. A separator according to claim 1 wherein a flange circumscribes the opening of the bladder and the opening of the bowl wherein the flange fastens the the bladder to the bowl.

4. A separator according to claim 1 wherein the bladder has an outside surface adjacent the interior surface of the bowl and wherein the interior surface of the bladder faces the centerline of the bowl.

5. A separator according to claim 4 wherein the interior surface of the bladder faces outwardly away from the centerline of the bowl when the bladder is in an inverted position.

6. A separator according to claim 4 wherein a space exists between the interior surface of the bowl and the outside surface of the bladder.

7. A separator according to claim 6 wherein a vacuum source is connected to the space between the interior surface of the bowl and the bladder, wherein the vacuum source draws the outside surface of the bladder towards the interior surface of the bowl.

8. A separator according to claim 7 wherein the shaft is hollow and the vacuum source connects with the space between thee interior surface of the bowl and the bladder through the hollow shaft.

9. A separator according to claim 8 wherein the vacuum source connects with the hollow shaft through a valve.

10. A separator according to claim 6 including a compressed air source is connected to the space between the interior surface of the bowl and the bladder, wherein the compressed air source pushes the bladder away from the interior surface of the bowl and through the opening in the lower end of the bowl.

11. A separator according to claim 10 wherein the shaft is hollow and the compressed air source connects with the space between the interior surface of the bowl and the bladder through the hollow shaft.

12. A separator according to claim 11 wherein the compressed air source connects with the hollow shaft through a valve.

13. A separator according to claim 1 wherein the at least one inlet sprays fluid entrained with solid particulate into the interior of the bladder through the lower opening of the bladder.

14. A separator according to claim 13 wherein the lower opening of the bladder has a perimeter, wherein the perimeter defines a plane circumscribing a space below the bottom opening and wherein the at least one inlet is located outside the space below the bottom opening.

15. A separator according to claim 13 wherein the spray of the at least one inlet has a sufficient force to hold the bladder against the interior surface of the bowl without pulling a vacuum on the bladder.

16. A separator according to claim 1 wherein the at least one inlet is at least one pair of injectors.

17. A separator according to claim 16 wherein the at least one inlet is a plurality of injectors.

18. A separator according to claim 1 wherein the interior surface of the bladder is irregular.

19. A separator according to claim 1 wherein the interior surface of the bladder is corrugated.

20. A separator according to claim 1 wherein the interior surface of the bladder has ridges and troughs.

* * * * *